United States Patent [19]

Pinske

[11] Patent Number: 4,770,423

[45] Date of Patent: Sep. 13, 1988

[54] PROJECTILE FOR USE IN GAMES

[76] Inventor: James E. Pinske, 5732 N. 94th St., Milwaukee, Wis. 53225

[21] Appl. No.: 138,551

[22] Filed: Dec. 28, 1987

[51] Int. Cl.[4] ..... A63B 67/18

[52] U.S. Cl. ..... 273/417; 273/423

[58] Field of Search ..... 273/417, 416, 420, 423

[56] References Cited

U.S. PATENT DOCUMENTS

| | | | |
|---|---|---|---|
| 2,116,304 | 5/1938 | Crespin | 273/417 |
| 4,657,262 | 4/1987 | Buckland | 273/417 |

FOREIGN PATENT DOCUMENTS

| | | | |
|---|---|---|---|
| 1045294 | 11/1958 | Fed. Rep. of Germany | 273/417 |
| 25803 | of 1905 | United Kingdom | 273/417 |
| 1505470 | 3/1978 | United Kingdom | 273/417 |

*Primary Examiner*—Paul E. Shapiro

*Attorney, Agent, or Firm*—Thomas F. Kirby

[57] ABSTRACT

A projectile adapted to be struck by a racquet or manually thrown in a game comprises a body portion and a relatively movable extendable/retractable vane portion mounted thereon. At the commencement of flight along a trajectory, the vanes in the vane portion are set in retracted position relative to the body portion. As the flight progresses, the vanes are gradually extended by a biasing mechanism at a controlled or timed rate to cause gradually increasing aerodynamic drag, thereby unpredictably altering the flight trajectory, shortening the flight distance and reducing the speed of the projectile than would otherwise occur if the vanes had remained retracted. Such extension or transformation adds a new element of anticipation and game strategy for the contestants. The vanes are reset to the retracted position for a subsequent flight either by striking the head of the body portion with a racquet (as in the case of a racquet game) or manually (as in the case of a dart-like throwing game).

15 Claims, 6 Drawing Sheets

PROJECTILE FOR USE IN GAMES

BACKGROUND OF THE INVENTION

1. Field of Use

This invention relates generally to projectiles, such as shuttlecocks or the like, for use in games and which can be batted or thrown along a trajectory by a player.

2. Description of the the Prior Art

In games such as shuttlecock or the like a small projectile, typically comprising a resilient head with a crown of feathers or plastic vanes projecting rearwardly therefrom, is batted back and forth by contestants using suitable racquets or paddles.

In other games similar to the game of darts, a projectile similar to that described above, but larger and heavier, is manually thrown by a contestant at a target or toward another contestant who aims to catch and return it.

Conventional shuttlecocks, for example, typically comprise a crown and base configuration whereby only a single type of flight path may be achieved. Trajectory, speed, and total distance travelled is dependent on wind conditions and the amount of initial impact received during flight. Conventional shuttlecocks characteristically have rather short, slow flights considering the amount of energy they receive during impact. Only a few shuttlecock designs allow for adjustability to alter flight path, or to compensate for varying wind conditions. Moreover, no prior art design of which applicant is presently aware has the feature of "in-flight" transformation of the crown flare to alter the trajectory, speed and flight distance of the shuttlecock.

The following patents illustrate the state of the art.

U.S. Pat. No. 4,657,262 shows a shuttlecock in which a connector element having flight feathers received therein is adjustably connected to a base member to enable alteration of the flight characteristics of the shuttlecock.

U.S. Pat. No. 2,153,251 shows a shuttlecock wherein a resilient head has a resilient flared rim to which feathers are attached and a compression band around the rim can be manually moved to adjust the flare of the rim and thereby change the disposition of the feathers relative to a common axis to regulate the speed and quality of the shuttlecock flight.

U.S. Pat. Nos. Des. 273,965 and Des. 287,989 are also of interest, as are U.S. Pat. Nos. 2,748,529 and 2,178,551 which disclose mechanisms for deploying parachutes from aerial toys in flight.

SUMMARY OF THE INVENTION

The present invention provides an improved projectile for use in games and which is adapted to be struck or thrown for flight along a trajectory. The projectile comprises a body portion and a vane or crown portion extending rearwardly therefrom. The body portion comprises a body base member having a head thereon and the vane portion comprises a vane base member which is slidably mounted on the body base member. A plurality of vanes are mounted on and extend rearwardly from the vane base member. The body base member is relatively movable with respect to the vane base member between forward and rearward positions. The vanes are pivotally movable radially between retracted (closed) and extended (open) positions. Means are provided to close the vanes when the body base member is moved from forward to rearward position either in response to a racquet stroke or manual setting movement of the head. Means are also provided to automatically return the vanes to open position during flight. Both means may be embodied in a single component or in an assembly of parts. Means are provided whereby vane deployment to open position is carried out at a timed or controlled rate of speed. Deployment may be at a constant gradual rate or may start out gradually and then snap open quickly. However, other deployment formats may be provided. Vane deployment in flight causes drag which affects the trajectory, distance and speed at which the projectile travels. The vane assembly may comprise a plurality of discrete vanes or the vanes may be integrally joined together along their edges and foldable to provide a one-piece cone-shaped crown.

A projectile in accordance with the invention offers several advantages over the prior art. For example, longer and higher flights are possible before the vanes deploy and the projectile reverts to a slow descent mode. The time-delay feature adds a new element of anticipation and game strategy for players and contestants and opponents. Unpredictability as to trajectory, distance and speed, as compared to known types of shuttlecocks and darts, also adds a new element of chance to the game. The projectile is relatively simple and sturdy in construction and is economical to manufacture. Other objects and advantages of the invention will hereinafter appear.

The several embodiments disclosed are examples only, and the invention is not restricted to these few possibilities. Other variations are possible, including any cross-breeding of features from one embodiment to another, as will be understood by those skilled in this art.

BRIEF DESCRIPTION OF THE DRAWINGS

The accompanying drawings depict several embodiments of projectiles in accordance with the present invention.

DESCRIPTION OF THE PREFERRED EMBODIMENTS

First Embodiment

Figure 1:
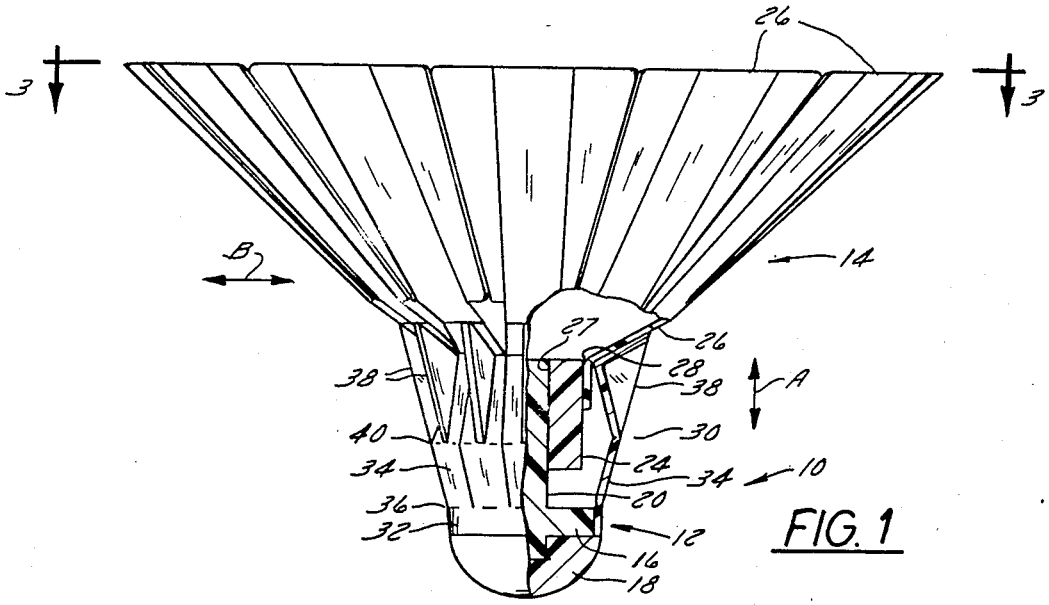
FIG. 1 is a side elevation view, partly in cross-section, of a first embodiment showing it in extended or open mode.
Figure 2:
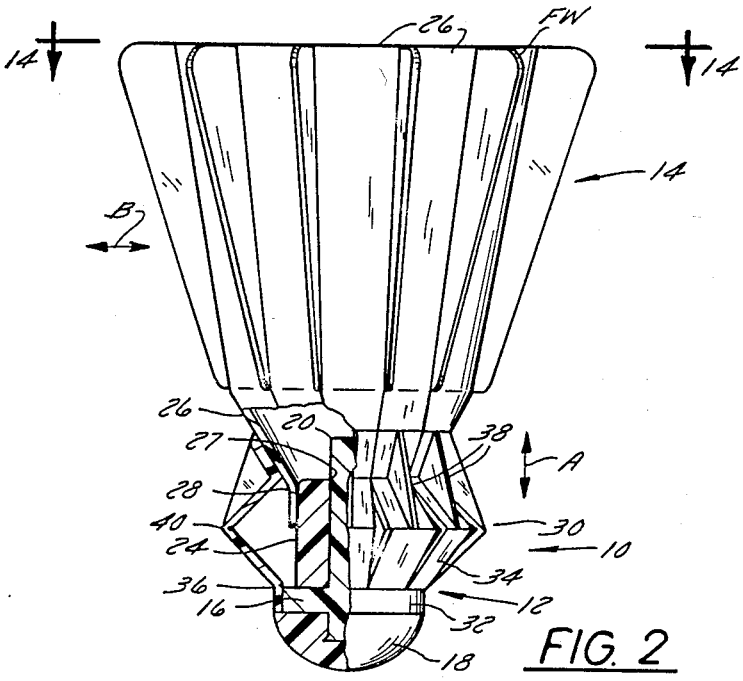
FIG. 2 is a view similar to FIG. 1 but showing the projectile in retracted or closed mode.
Figure 3:
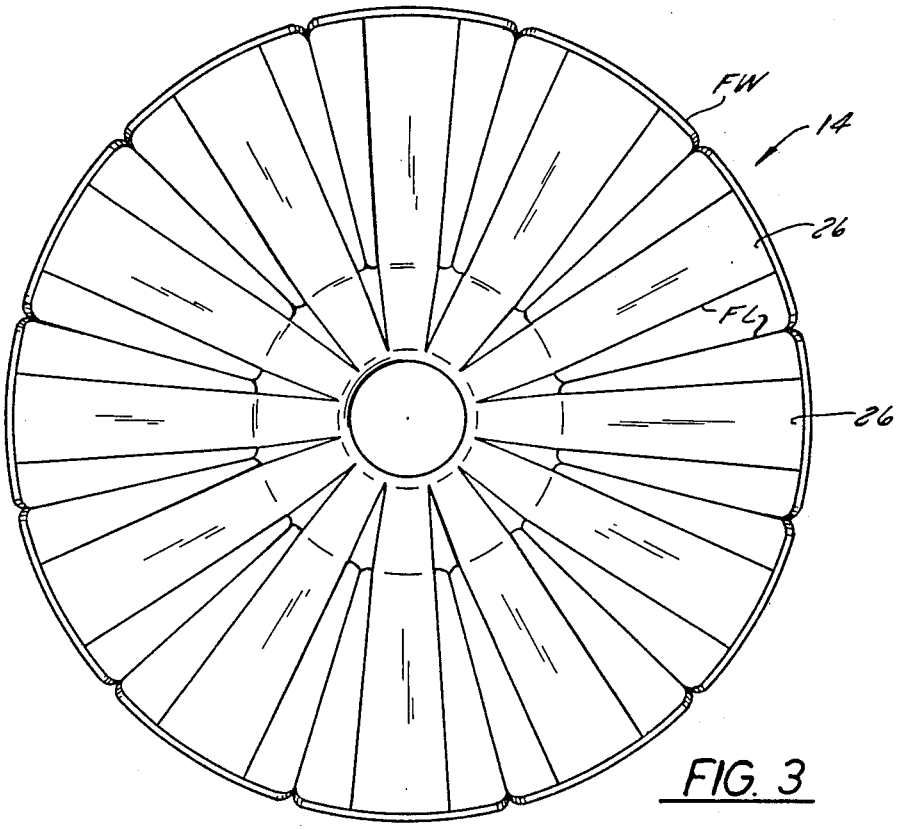
FIG. 3 is a rear end elevation view of the projectile taken on line 3—3 of FIG. 1.

FIGS. 1, 2 and 3 show a projectile 10 in accordance with a first embodiment of the invention which is adapted to be struck or thrown for flight along a trajectory. Projectile 10 has a front end, a rear end and a longitudinal axis and is adapted to travel front end first along the trajectory. Projectile 10 comprises a body portion 12 at the front end thereof, a vane or crown portion 14 at the rear end thereof and connected to the body portion, which vane portion 14 is movable radially relative to the axis between retracted (closed) and extended (open) positions, and means 30 to effect movement of the vane portion from closed position (FIG. 2) to open position (FIG. 1) while the projectile is in flight to alter its flight characteristics. Projectile 10 includes time delay means operable to control the rate of speed at which vane portion 14 moves from closed to open position. Body portion 12 comprises a body base member or circular piston 16 having a resilient hemispherical head 18 rigidly secured to its front end and a rearwardly extending guide rod or pin 20 integrally formed on its rear side.

Figure 14:
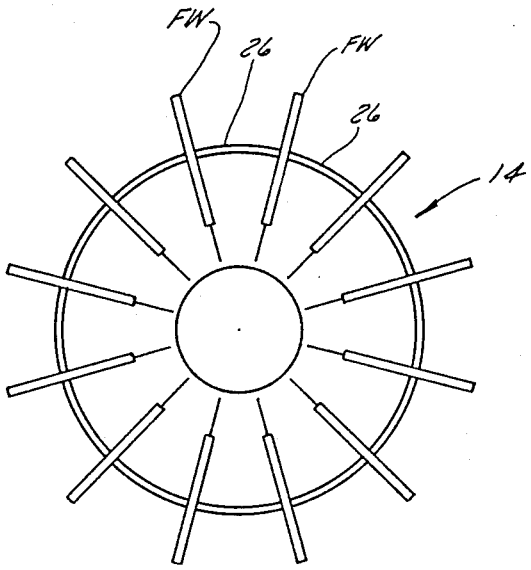
FIG. 14 is a view similar to FIG. 3 taken on line 14—14 of FIG. 2.
Figure 18:
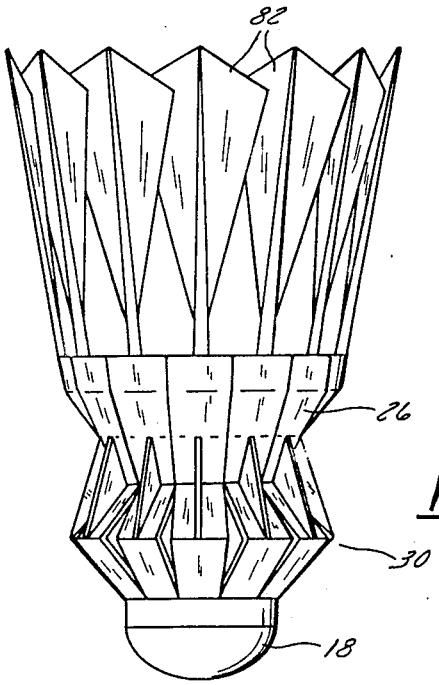
FIG. 18 is a variation of the first embodiment shown in FIGS. 1 and 2.

Vane portion 14 comprises a hollow cylindrical vane base member or vane insert 24 having a bore 27 therethrough and a plurality of vanes 26 mounted on insert 24. Body portion 12 is connected to and is relatively movable with respect thereto. Thus, guide rod 20 is slidably movable along the axis in the direction of arrow A between a forward position (FIG. 1) and a rearward position (FIG. 2). The vanes 26 are pivotally connected to and extend rearwardly from vane insert 24 as at 28 and are relatively pivotally movable with respect thereto radially of the axis in the direction of an arrow B between a retracted position (FIG. 2) and an extended position (FIG. 1). FIGS. 3 and 14 are rear end elevational views showing the vanes 26 in open and closed positions, respectively. The vanes 26, which are integrally joined together along their edges, and which are foldable along fold-lines FL (FIG. 3), define a one-piece, conically-shaped member which is fabricated of flexible, lightweight material, such as paper, plastic MYLAR (TM) film or other suitable material. If preferred, as FIG. 18 shows, vane portion 14 may comprise a plurality of discrete vanes in the form of actual or simulated feathers 82 (FIG. 18).

Vane insert 24 is designed to be relatively massive or heavy, as compared to body portion 12, to facilitate relative movement therebetween when head 18 of projectile 10 is struck by a racquet, as hereinafter explained.

The means 30 operate to effect movement of vane portion 14 and comprise biasing means connected between body portion 12 and vane insert 24 to effect movement of the vanes 26 to open or extended position as body portion 12 returns to forward position. The aforementioned time delay means are also embodied in means 30 and timing is a function of the resiliency thereof and frictional engagement between guide rod 20 and bore 27 in vane insert 24, as hereinafter explained.

The means 30 also operate to move the vanes 26 to closed position (FIGS. 2 and 14) when body base member or piston 16 is set in rearward position (FIG. 2), either in response to a racquet stroke against body head 18 or manual resetting movement of piston 16. Relative motion effected by a racquet stroke is facilitated by the mass differences between body portion 12 and vane insert 24. The means 30 also serves as a biasing means which operate to automatically return the vanes 26 from closed to open position at a controlled or timed rate of speed while the projectile is in flight.

The means 30 takes the form of a single unitary element which is preferably fabricated of molded resilient plastic and comprises a cylindrical collar 32 fixedly secured as by gluing to circular piston 16, a plurality of rearwardly and outwardly extending wall or leg sections 34 pivotally and integrally connected at one end to collar 32 as at 36, and a plurality of fixed strengthening and attachment members 38, each integrally and pivotally connected to the other end of a wall section 34 as at 40 and secured as by gluing to a vane 26.

The purpose of element 30 is to transmit energy to effect opening and closing of crown 14 from piston 16 to crown 14. The design of element 30 is such that it folds or collapses in an axial direction when an axial force is applied to it in one direction (FIG. 2). The design of the wall sections 34 may be such that they either flex gradually or bend along their entire length, or have definite pivot points 36 and 40 which form resilient or "live" hinges. In either case, the material selected for element 30 is such that its inherent resiliency and flexibility enable it to serve as a biasing means and a timing means to effect a gradual, controlled or timed rate of return to the position shown in FIG. 1. This type of return provides the desired delay for control of the opening of the vane or crown portion 14.

One possible alternative or adjunct to effect time delay is by means of the friction created by an interference fit between selected mating parts. Referring to FIG. 1, an interference friction fit between guide rod 20 and bore 27 in vane insert 24 is selected to effect gradual axial slippage during relative movement between those two parts, especially as they move to the position shown in FIG. 1.

Figure 2A:
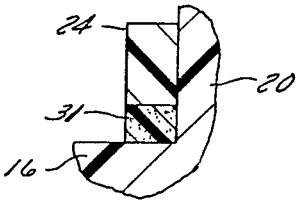
FIG. 2A is a fragmentary view showing an alternative form of time delay means for the first embodiment.

As FIG. 2A shows, another possibility to achieve biased return and time delay is to use an energy absorbing resilient compressible member 31, such as a foam rubber or plastic block, at an appropriate location, as between the front end of insert member 24 and the rear side of piston 16.

Figure 2B:
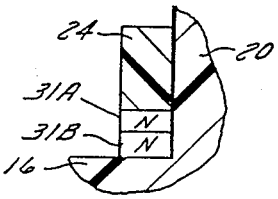
FIG. 2B is a fragmentary view showing an alternative form of biasing means for the first embodiment.

As FIG. 2B shows, still another possible alternative to achieve biased return is to use a pair of permanent magnets 31A and 31B, affixed to the front end of insert member 24 and the rear side of piston 16, respectively, and disposed so as to repel one another and thus serve to bias those components to open position (FIG. 1). Both embodiments in FIGS. 2A and 2B are usable in conjunction with time delay means.

Preferably, head 18 of projectile 10 is made of resilient compressible material, such as rubber or plastic foam, that absorbs part of the energy from a racquet stroke to thereby prevent damage to the projectile and reduce the risk of injury or damage to a person or object struck by the projectile.

Operation of the First Embodiment

When projectile 10 is used in a racquet game, striking head 18 with a racquet causes body base member or piston 16 to move rearward (FIG. 2) and the vanes 26 to close. Projectile 10 then turns and commences its flight along the trajectory at maximum speed. As it flies, base member or piston 16 is biased to its forward position (FIG. 1) at a controlled rate by element 30 and the vanes 26 gradually move toward extended or open position (FIG. 1). Such vane deployment causes aerodynamic drag which affects the trajectory, the distance and the speed at which the projectile travels and results in unpredictable flight descent characteristics. This poses an unpredictable challenge to the other contestant who aims to strike and return the projectile.

Projectile 10, in vane-open position, is impacted with a force at head 18. The mass of vane portion 14 causes element 30 to collapse axially and this causes the vanes 26 to move to closed or retracted position. Simultaneously, piston rod 20 moves axially through bore 27. As element 30 returns to uncollapsed position, friction between rod 20 and the wall of bore 27 causes a short delay or slow-down in the spring-biased return of element 30 and delays the opening of the vane portion 14.

When projectile 10, suitably adapted as to size, shape and weight, is used in a dart-type game wherein it is to be manually thrown at a target, body portion 12 is manually moved to its rearward position relative to vane insert 24 by the contestant prior to throwing the projectile. Once in flight, the piston 16 is moved forward by element 30 and the vanes 26 gradually deploy as described above.

Second Embodiment

Figure 4:
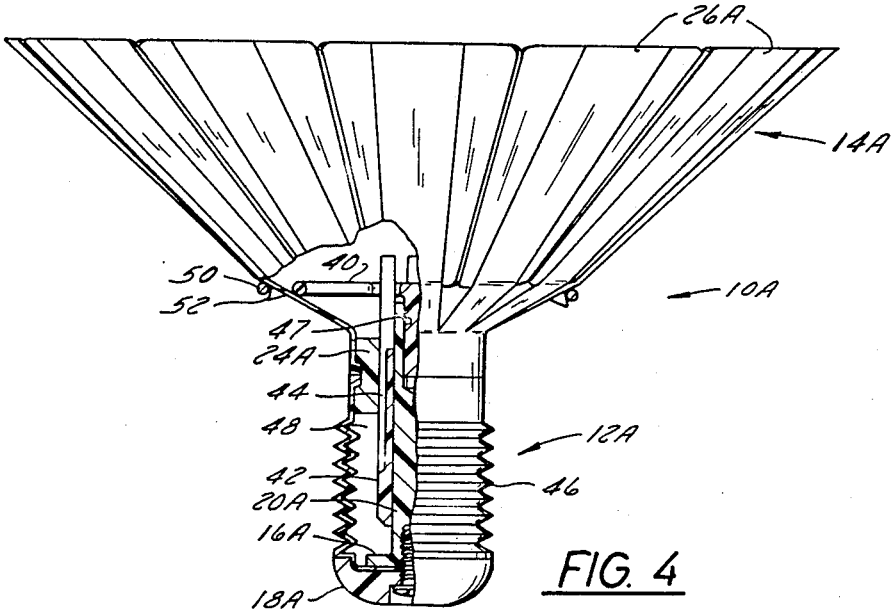
FIG. 4 is a view similar to FIG. 1 of a second embodiment of a projectile in accordance with the invention.

FIG. 4 shows projectile 10A in accordance with a second embodiment of the invention and FIGS. 5 through 13 depict components thereof. Projectile 10A comprises a body portion 12A and a vane or crown portion 14A and operates in a manner similar to projectile 10 hereinbefore described.

Figure 10:
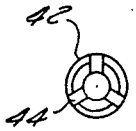
FIGS. 5 through 13 are views of various components depicted in FIG. 4.
Figure 8:
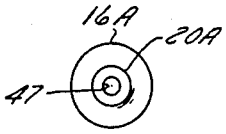
Figure 5:
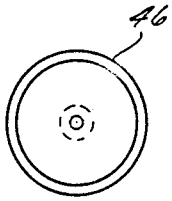
Figure 12:
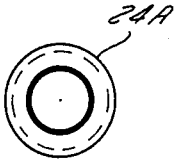
Figure 7:
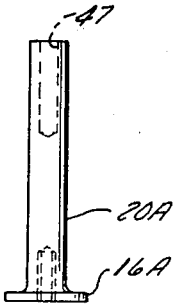
Figure 6:
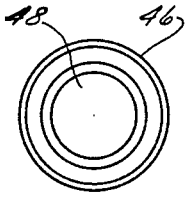
Figure 9:
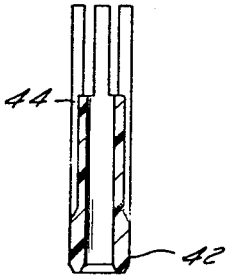
Figure 11:
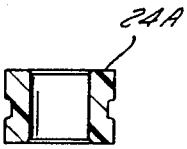
Figure 13:
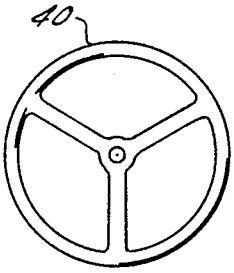

Body portion 12A comprises a base member or piston 16A (FIGS. 4 and 7) having a head 18A thereon (FIG. 4) and having a rearwardly extending base post 20A thereon (FIGS. 4, 7 and 8). A base ring element 40 (FIGS. 4 and 13) is snuggly secured to the end of base post 20A. A piston sleeve 42 (FIGS. 4, 9 and 10 is rigidly (but slidably adjustable axially) mounted on base post 20A to define air holes or passages 44 for a bellows 46.

Vane portion 14A comprises a vane base member or vane insert 24A (FIGS. 4, 11 and 12) to which a plurality of vanes 26A are pivotally attached and which is slidably mounted on piston sleeve 42. The exterior surface of vane or crown portion 14A is provided with a plurality of integrally formed projections or lobes 52 that serve to support and retain an elastic band 52 which encircles vane portion 14A and operates as a biasing means to bias the vanes 26A to closed or retracted position when the projectile is struck and in flight.

The multiple-fold bellows 46 (FIGS. 4, 5 and 6) is connected between the front end of base member 16A and vane insert 24A. Bellows 46 contain an interior space or chamber 48 which communicates to atmosphere through the air passages 44 in piston sleeve 42. The bellows 46 freely expels air from its chamber 48 when it is collapsed axially by an impact force on head 18A, provided that the orifices of the passages 44 are large enough to permit this. However, orifices of reduced size restrict the expulsion and return of air from and to the bellows 46 to thereby provide a timing function. The bellows 46, being resilient and elastic, also serves as a biasing means or spring which operates to return body portion 12A to its forward position and deployment of the vanes 26A. The piston sleeve 42 fits snuggly on the base post 20A, but may be adjustably moved axially along post 20A either to adjust the size of the orifices for the air passages 44 or to vary the frictional fit between piston sleeve 42 and vane insert 24A. The ring element 40, which serves as a fulcrum or cam about which the vanes 26A can slide and pivot, fits snuggly into a hole 47 in the upper end of base post 20A, but may be selectively moved axially relative to the base post to enable adjustability of the extent to which the crown portion 14A can open.

Operation of the Second Embodiment

The projectile 10A, while its vane portion 14A is open, is impacted by a force at head 18A. The mass and inertia of vane portion 14A relative to body portion 12A causes the bellows 46 to collapse and expel air from chamber 48 through the passages 44. The base piston 16A, post 20A and ring element 40 move rearwardly as a unit relative to vane portion 14A. The vanes 26A are pivoted to closed position on ring element 40 by elastic band 50. Projectile 10A thus assumes the condition that enables its fastest, longest and highest phase of flight. When bellows 46 re-expands, the piston 16A, post 20A and ring element 40 cause the vanes 26A to resume open position. The intentional time delay in vane re-deployment is effected either by the rate of air return to the bellows 46 or the frictional engagement between piston sleeve 42 and the vane insert 24A or a combination of both, depending on projectile design. At this phase of flight, projectile 10A is in its slowest descent mode and is ready to repeat the cycle when struck again.

Third Embodiment

Figure 17:
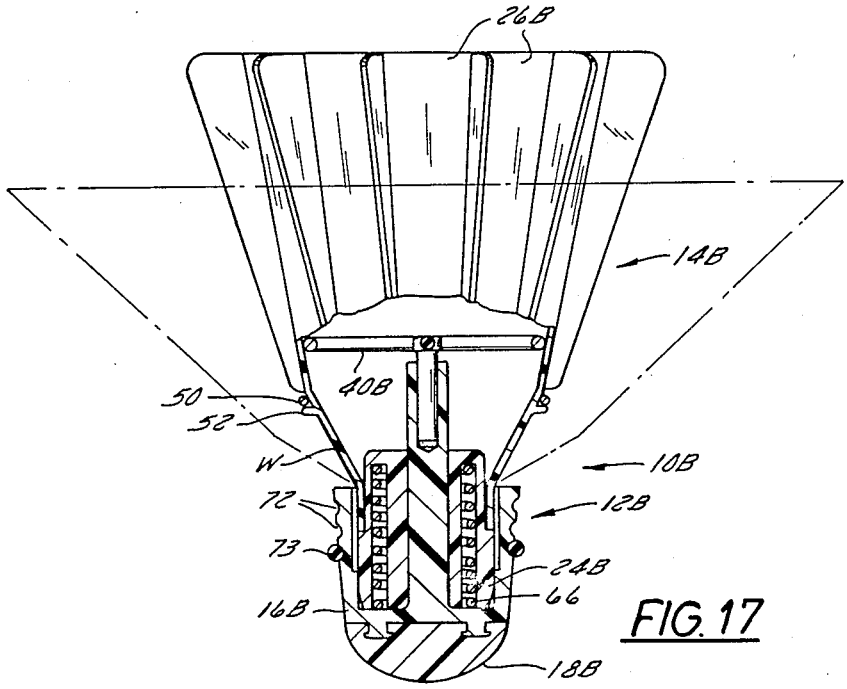
FIG. 17 is a view similar to FIG. 16 showing it in the retracted mode.
Figure 16:
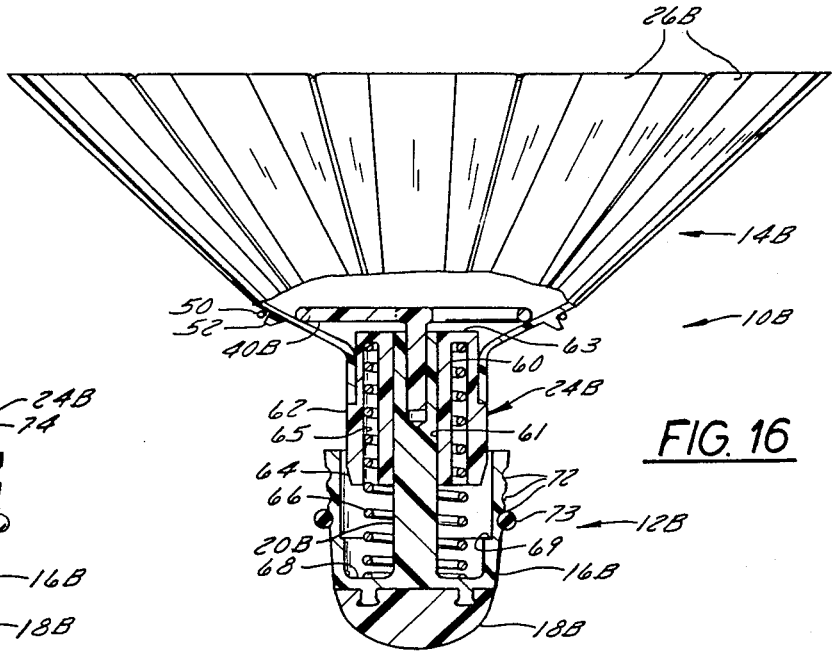
FIG. 16 is a side elevation view, partly in cross-section, of the entire third embodiment of FIG. 15 showing it in extended mode.
Figure 15:
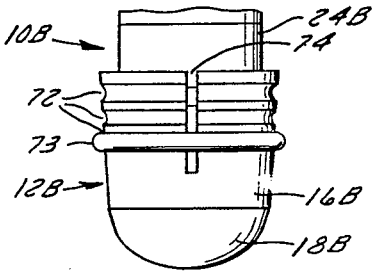
FIG. 15 is a side elevation view of a portion of a third embodiment of a projectile in accordance with the invention.

FIGS. 15, 16 and 17 show a projectile 10B in accordance with a third embodiment of the invention. Projectile 10B comprises a body portion 12B and a vane or crown portion 14B which is identical to crown portion 14A in projectile 10A hereinbefore described, except for the configuration of vane base member or vane insert 24B. The latter comprises an inner hollow cylindrical portion 60 having a bore 61 therethrough and an outer hollow cylindrical portion 62, chamfered as at 64, which concentrically surrounds, is spaced from, and is joined at its upper end to the upper end of portion 60 by an end wall 63 to define a spring-receiving space 65.

Body portion 12B of projectile 10B comprises a cup-shaped hollow body base member 16B having a head 18B thereon and having a rearwardly-extending center post 20B which is slidably received in bore 61 in vane insert 24B. A helical compression spring 66 is disposed in cylindrical space 65 between upper end wall 63 of insert 24B and a bottom wall 68 of body base member or cup 16B. A cam or ring element 40B is snuggly secured to the end of base post 20B. Cup-shaped member 16B, which is formed of resiliently flexible material such as rubber or plastic, has an inner wall surface with a step or shoulder 69 formed therein whereby the inside diameter of cup 16B is slightly larger at its rear end than at its forward end. Cup 16B has an outer wall surface which tapers or narrows toward its head end and is provided therearound with a plurality (three shown) of longitudinally spaced-apart annular grooves 72, each of which is adapted to receive and engage a fixed-diameter tension ring 73. Ring 73 can be located in any of the grooves 72 to adjustably vary the friction between the inner surface of cup 16B and the outside surface of cylindrical portion 62. Base member or cup 16B has one or more axially extending slits 74 through its side wall to enhance its flexibility.

Operation of the Third Embodiment

Projectile 10B, with its vane portion 14B open, is impacted by a force at its head 18B. The mass and inertia of vane portion 14B relative to body portion 12B causes cup 16B to move toward crown insert 24B until it bottoms out, causing spring 66 to compress (FIG. 17). The outside surface of vane insert 24B frictionally engages the smaller-diameter inside surface portion of cup 16B. As the compressed spring 66 begins to re-expand, it exerts an axial force to push crown portion 14B and body portion 12B apart. The frictional slippage between the afore-described engaged surfaces causes a time delay. When vane insert 24B reaches the sidewall portion of cup 16B where a looser fit occurs, crown portion 14B returns quickly to its deployed condition. In other words, the time delay effects vane deployment which initially proceeds relatively slowly and gradually and then suddenly proceeds very rapidly. The ring element 40B cams against the vanes 26B to cause the vanes to open. The amount of time delay can be regulated by placing the tension ring 73 in various positions by means of the grooves 72. Instead of discrete grooves 72 as shown, a spiral thread (not shown) and a light-weight nut therefor (not shown) could be employed for timing adjustment.

Fourth Embodiment

Figure 20:
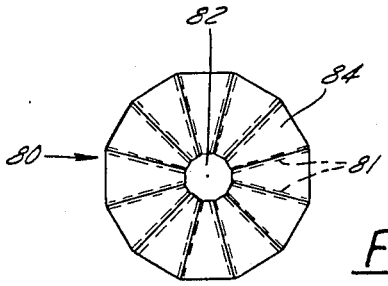
FIG. 20 is a top plan view of a component shown in FIG. 19.
Figure 19:
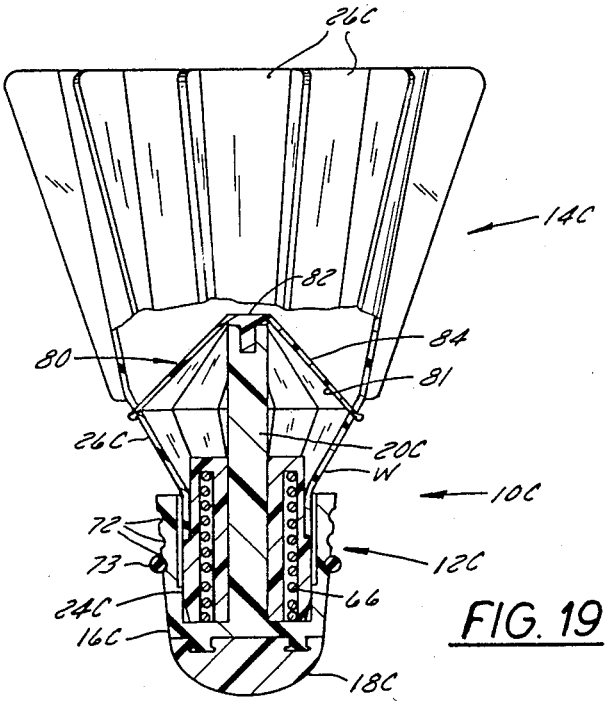
FIG. 19 is a side elevation view, partly in cross-section, of a fourth embodiment and showing it in retracted mode.

FIGS. 19 and 20 show a projectile 10C in accordance with a fourth embodiment of the invention. Projectile 10C comprises a body portion 12C and a vane or crown portion 14C, both similar to those shown in the third embodiment of FIGS. 15 and 16, except that cam ring element 40B, the projections 52 and the elastic band 50 are omitted and replaced by a linkage assembly or means 80. Linkage assembly 80 comprises a plurality of radially extending arms or spokes 81, each of which is integrally and pivotally connected at its inner end to a hub 82 which is rigidly secured to a base post 20C. Each spoke 81 is pivotally connected at its outer end to a primary web W of a vane 26C of vane portion 14C. Each spoke 81, which is fabricated of resilient elastic plastic or the like, is self-biased outwardly and serves as a spring tending to move its associated vane 26C toward open or deployed position. Linkage assembly 80 further comprises a flexible foldable fabric or paper web 84 which covers it and is secured to the spikes 81 to increase drag.

If preferred, the hub 82, spokes 81 and web 84 could be formed as a single unitary resilient plastic member (not shown) having slits (not shown) therein to enable foldability and operating as a biasing means to bias the crown portion 14C to open position.

Operation of the Fourth Embodiment

Projectile 10C is employed and operates in the same manner as other embodiments previously described.

Crown Portion

With respect to the vane or crown portions shown in the various embodiments, and especially crown portion 14 shown in FIGS. 1, 2, 3 and 14, it is to be understood that it opens and closes in a manner similar to an umbrella canopy or blossoming flower and assumes a conical form in both open and closed configurations. It may be made of any type of light-weight, flexible, foldable, sheet material, such as paper or plastic or other suitable materials. The preferred shape is disclosed herein, but other variations of "blossoming" type crowns are contemplated as being within the scope of the claims.

Referring to FIG. 14, the crown portion, as viewed in closed position, appears as a circle that is divided into, for example, twelve equal curved arc segments or primary webs 26. Alternatively, flat segments (not shown) could be provided and would be preferable as they would more readily bend in moving between open and closed position. Adjacent to each primary web 26 is a radially extending folded web pair FW. Each folded web pair FW may be designed to fold either inwardly (not shown) or outwardly as shown. Although the depicted crown has twelve segments, a greater or lesser number could be employed.

It is possible, as FIG. 18 shows, that folding web pairs could be omitted; in which case the primary webs 26 are greatly shortened and are similar to very wide spokes or blades radially extending from the center of the crown. Each shortened primary web 26 contains a recepticle hole (not visible) into which an individual vane, plume or feather-like appendage 82 is inserted. Another variation for a crown portion could resemble a convoluted or corrugated fan (not shown) formed into a conical/-cylindrical shape.

Furthermore, the vanes could be provided with air holes (not shown) of desired shape therethrough to further alter the flight characteristics of the projectile. Thus, it is apparent that the crown portion can take various forms without departing from the scope of the present invention.

I claim:

1. A projectile having a front end, a rear end and a longitudinal axis and adapted to be struck or thrown along a trajectory front end first, said projectile comprising:

a body portion at the front end of said projectile;

a vane portion at the rear end of said projectile and connected to said body portion, said vane portion being movable radially relative to said axis between retracted and extended positions;

and means to effect movement of said vane portion from retracted to extended position while said projectile is in flight to alter its flight characteristics.

2. A projectile according to claim 1 including time delay means operable to control the speed of movement of said vane portion toward said extended position.

3. A projectile according to claim 2 wherein said vane portion comprises a vane base member and a plurality of vanes, said body portion being connected to said vane base member and being relatively movable with respect thereto along said axis between a forward position and a rearward position, said plurality of vanes being connected to said vane base member and being relatively movable with respect thereto radially of said axis between a retracted position and an extended position;

and wherein said means to effect movement of said vane portion comprises biasing means to effect movement of said vanes to extended position as said body portion returns to forward position.

4. A projectile according to claim 3 wherein said body member comprises a piston and guide means extending rearwardly therefrom and wherein said vane base member is slidably mounted on said guide means.

5. A projectile according to claim 4 wherein said biasing means comprises an element having a resilient flexible wall section connected between said piston and said vanes for biasing said body portion to forward position and said vanes to extended position.

6. A projectile according to claim 5 wherein said time delay means is embodied in said element and is a function of the resiliency thereof.

7. A projectile according to claim 5 wherein said time delay means is embodied in said guide means and said vane base member and is a function of the frictional engagement therebetween.

8. A projectile according to claim 4 wherein said guide means comprises a guide rod, wherein said vane base member is a hollow sleeve slidably mounted on said rod, wherein said biasing means comprises a resilient member disposed between said piston and said vane base member, and wherein said biasing means further comprises a circular cam ring mounted on said rod and disposed within said vane portion and slidably engaged with said vanes to enable said vanes to pivot, and an elastic band around the outside of said vane portion to bias said vanes against said cam ring.

9. A projectile according to claim 8 wherein said resilient member is a helical compression spring disposed around said guide rod.

10. A projectile according to claim 9 wherein said time delay means comprises adjusting means for adjusting the frictional engagement between said sleeve and said body portion.

11. A projectile according to claim 10 wherein said adjusting means comprises a ring or band disposed in one of a plurality of grooves in said body portion for compressing said body portion against said sleeve.

12. A projectile according to claim 8 wherein said resilient member is a bellows.

13. A projectile according to claim 12 wherein said time delay means comprises an air hole in said bellows to control the rate of inflow of air into said bellows as said bellows expands back to normal position.

14. A projectile according to claim 3 wherein said biasing means is disposed between said body portion and said vane base member and comprises a resiliently compressible foam member.

15. A projectile according to claim 3 wherein said biasing means is disposed between said body portion and said vane base member and comprises a pair of permanent magnets which are arranged to repel each other.

* * * * *